United States Patent [19]

Abramo

[11] Patent Number: 5,014,068

[45] Date of Patent: May 7, 1991

[54] TRANSMISSION COUPLER ANTENNA

[75] Inventor: Robert S. Abramo, San Diego, Calif.

[73] Assignee: The United States of America as represented by the Secretary of the Navy, Washington, D.C.

[21] Appl. No.: 467,833

[22] Filed: Jan. 19, 1990

[51] Int. Cl.[5] ..... H01Q 1/34

[52] U.S. Cl. ..... 343/710; 343/848

[58] Field of Search ..... 343/710, 720, 897, 846, 343/847, 848, 849

[56] References Cited

U.S. PATENT DOCUMENTS

| | | | |
|---|---|---|---|
| 1,962,041 | 6/1934 | Spong . | |
| 2,840,700 | 6/1958 | Browder | 343/710 |
| 2,894,124 | 7/1959 | Himmel et al. . | |
| 3,372,395 | 3/1968 | Kline . | |
| 3,803,615 | 4/1974 | Goodbody . | |

*Primary Examiner*—Michael C. Wimer

*Attorney, Agent, or Firm*—Harvey Fendelman; Thomas Glenn Keough

[57] ABSTRACT

A broad band HF communications antenna for surface ships has an increased survivability over the currently used twin fan antennas. Capacitively coupling a long, flat conductive strap to existing ship structures helps achieve broadband performance. Integral end sections of the long, flat conductive strap are bent at each end and a dielectric layer with a low dielectric constant is provided along the length of each end section. The end sections and dielectric layers provide the areas needed for capacitive coupling to a mast and stack or other parts of the ship's superstructure thereby creating a survivable and broadband HF communications antenna design.

7 Claims, 4 Drawing Sheets

TRANSMISSION COUPLER ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A major consideration for successful maritime operations and, in particular, among the elements of an effective battle force, is the ability to communicate, most likely in the HF frequency spectrum. Present marine design and contemporary naval architecture utilize antenna designs which are, in many cases, over thirty years old. Most antenna systems on Navy surface combatant ships are not totally combat survivable.

This has proven to be especially true of the design known as the twin fan wire rope broadband HF communications antenna that is normally built for 2–6 MHz transmit/2–12 MHz receive duplex operation. The antenna consists of two sets of elements tied together and fed at one end. Each set of elements has three or more braided cables tied together at an apex end and fanned out at the other end for broadband operation. Orientation of the wires can range from horizontal to vertical. They can be positioned horizontally from the foremost to aft or at any angle with the horizontal. Although it does radiate, the twin fan antenna is primarily used to excite surrounding ship structures; at low HF frequencies, the electrical wavelength is sufficiently large that the entire ship above the water line becomes the actual radiator, or antenna. The twin fan antenna is one approach toward capacitively/inductively coupling existing tall ship structures in order to provide increased effective height and, consequently, improve radiation efficiency.

Unfortunately, many antennas, including the twin fan configuration, are "cheap kill" victims. In addition to being susceptible to damage from extreme adverse weather conditions, they are susceptible to damage from air blasts, overpressure waves, shock and vibrations and the excessively high temperatures that may result from near-miss detonations.

Thus, there is a continuing need in the state of the art for a survivable antenna design capable of broadband operation in the HF frequency spectrum that additionally presents a more compact or low profile mechanical design.

SUMMARY OF THE INVENTION

The present invention is directed to providing a survivable method of and apparatus for assuring broadband HF antenna capability for surface ships. A single elongate flat conductive strip provided with an antenna coupling cable or lead and having integral end sections at opposite ends is contiguously provided with a dielectric layer on each of the integral end sections and is appropriately mounted on portions of a ship's superstructure to excite the entire ship to function as the high frequency communication antenna. Optionally, stanchions can be provided to couple the end sections of the elongate flat conductive strip when the ship's superstructure is incapable of conforming to the end sections. When stanchions are employed, appropriate ground wires to the ship's structure optionally are included. The method of providing a survivable shipboard broadband high frequency communications antenna calls for the positioning of an elongate flat conductive strip between portions of a ship's superstructure. Fashioning integral end sections at opposite ends of the elongate flat conductive strip to conform with portions of the ship's superstructure allows the interposing of a dielectric layer between each conforming integral end section and the portion of the ship's superstructure. Mounting the integral end portions and each dielectric layer on the ship's superstructure allows excitation of the entire ship to function as the HF communications antenna.

A prime object of the invention is to provide a survivable shipboard broadband HF communications antenna.

Another object is to provide a broadband HF antenna whose survivability approximates that of the mast and superstructure to which it is coupled.

Another object is to provide a survivable HF broadband antenna capacitively coupled at opposite ends to the tall structure of a ship.

Another object is to provide a survivable shipboard broadband HF communications antenna employing but a single nominally flat conductor as opposed to multiple wire ropes and associated structure in conventional antenna design.

Another object is to provide a survivable shipboard broadband HF communications antenna configured to replace the conventional twin fanned broadband HF antenna currently in fleet use.

Another object of the invention is to provide a survivable HF communications antenna in which a single strap has integral end sections capacitively coupled to the ship's tall structure.

Another object of the invention is to provide a combat survivable shipboard broadband HF communications antenna configured to reduce interference with a ship's radars as compared with contemporary designs.

Yet another object is to provide an integral survivable shipboard broadband HF communications antenna capacitively coupled at opposite ends to excite ship structures.

These and other objects of the invention will become more readily apparent from the ensuing specification and drawings when taken in conjunction with the appended claims.

DESCRIPTION OF THE PREFERRED EMBODIMENT

The design of the survivable shipboard broadband HF communications antenna is related to the concept of characteristic modes which is set forth by Robert J. Garbacz et al. in their article entitled "A Generalized Expansion for Radiation and Scattered Fields" *IEEE Transaction on Antennas and Propagation* Vol. AP 19, No. 3, May 1971. A design payoff of considering the characteristic mode concept will include both acceptable broadband HF electromagnetic properties as well as survivable properties of an antenna. A characteristic mode antenna may provide broadband impedance behavior with a more compact or low profile mechanical design. It was found in the course of the design of this inventive concept that such an antenna could be made more survivable when it included part of the ship's superstructure.

The characteristic modes of a body are related to the fundamental or natural resonances of that body. A conducting body is known to possess natural resonances that are inherently related to the physical shape and dimensions of the body. In fact, these resonances are utilized and enhanced in the design of the conventional shipboard fan antenna to aid its broadband performance. However, there is no evidence to support the clear, overt use of the characteristic mode concept in the design of the conventional twin fan antenna and from the available indications it appears that the twin fan antenna has been the product of applying experience and trial and error.

Conceptually, the characteristic mode antenna may consist of an array of excitation structure appropriately placed on a ship and simultaneously driven to excite the characteristic modes or natural resonances in a manner that will achieve a desired broadband operation. The broadband operation includes an omnidirectional azimuth pattern, a 3:1 or 4:1 voltage-standing-wave-ratio and a high radiating efficiency over the transmitting band, in this case in the HF frequency region.

Figure 1:
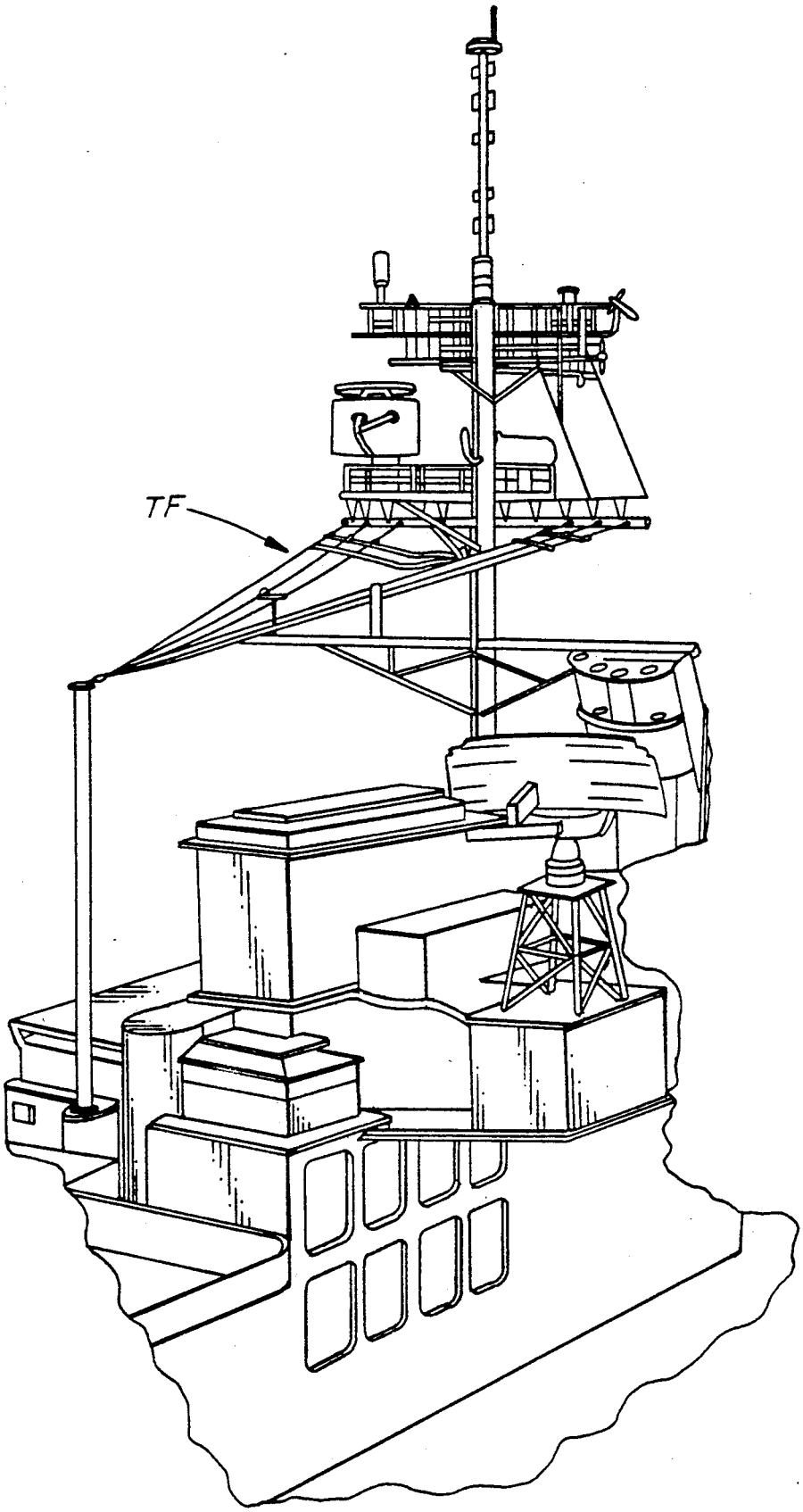
FIG. 1 (Prior Art)
FIG. 1 shows a conventional 2–6 MHz fan antenna aboard a surface combat ship.

Referring now to FIG. 1, a prior art or conventional twin fan antenna TF is depicted as it typically reaches across some of a ship's superstructure. It is clear to even a casual observer that this antenna arrangement is vulnerable to damage in even the best of conditions and it is not surprising that severe weather conditions could impair its functioning. Certainly, such an arrangement would suffer in combat in the vicinity of incoming ordnance. Onboard launching of ballistic and guided missiles might produce shock waves that could compromise such a design as well.

Figure 2:
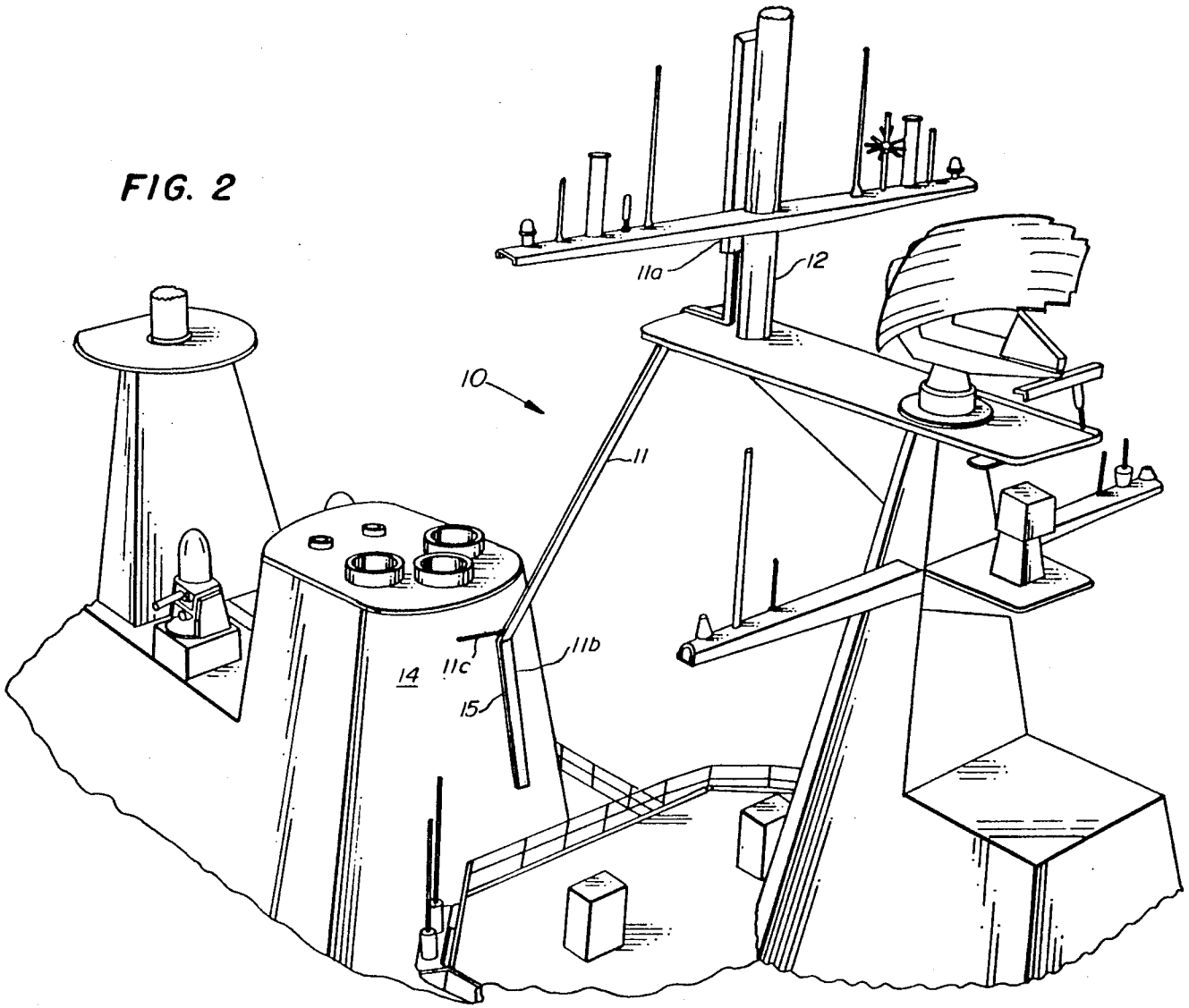
FIG. 2 is an isometric depiction of the invention capacitively coupled at opposite ends to the mast and stack of the tall structure of a ship.

Because of the limitations of the conventional twin fan antenna a survivable shipboard broadband HF communications antenna 10 herein is presented, see FIG. 2. The uncomplicated, yet reliable design, assures that bidirectional HF communications will prevail in all but the most severe hostile combat situations.

Antenna 10 represents a different approach to the problem of exciting existing ship structures and uses capacitive/inductive coupling to existing structure in a manner which is distinct from the cut-and-try conventional approach used with twin fan antenna couplings. The antenna includes a long, flat conductive strap 11 that is capacitatively coupled along end sections 11*a* and 11*b* to a ship's tall structure, in this case to a mast 12 and a stack 14, respectively. The antenna places long coupling sections 11*a* and 11*b* that integrally extend from each end of an intermediate section of the flat conductive strap 11 to provide the needed coupling. The flat conductive strap works as an exciting element that reaches from foremost mast 12 at some angle to another vertically extending, grounded structure, such as stack 14. End sections 11*a* and 11*b* are bent at an appropriate angle to accommodate the surface of the superstructure and continue parallel, along it for some length.

A contiguous dielectric layer 13 or 15 is included to contiguously separate the end sections from the ship's structure, in this case mast 12 and stack 14, respectively. The integrally extending end sections 11*a* and 11*b* and contiguous dielectric layers 13 and 15 are suitably mechanically mounted on the ship's superstructure by appropriate dielectric mounting means 20. These may be selected from a multitude of adhesives, straps, clamps, and some fasteners such as nonconductive bolts, rivets, etc. to secure these elements to the superstructure yet not ground end portions 11*a* and 11*b* to the ship's superstructure nor compromise the insulative properties of the dielectric layers. The integrally extending end sections 11*a* and 11*b* and contiguous dielectric layers 13 and 15 may be considered to be distributed coupling capacitances whose coupling characteristics can be regulated by varying their cross-sectional area (length and width) and their distance from the existing structures to which they are coupled.

Figure 3:
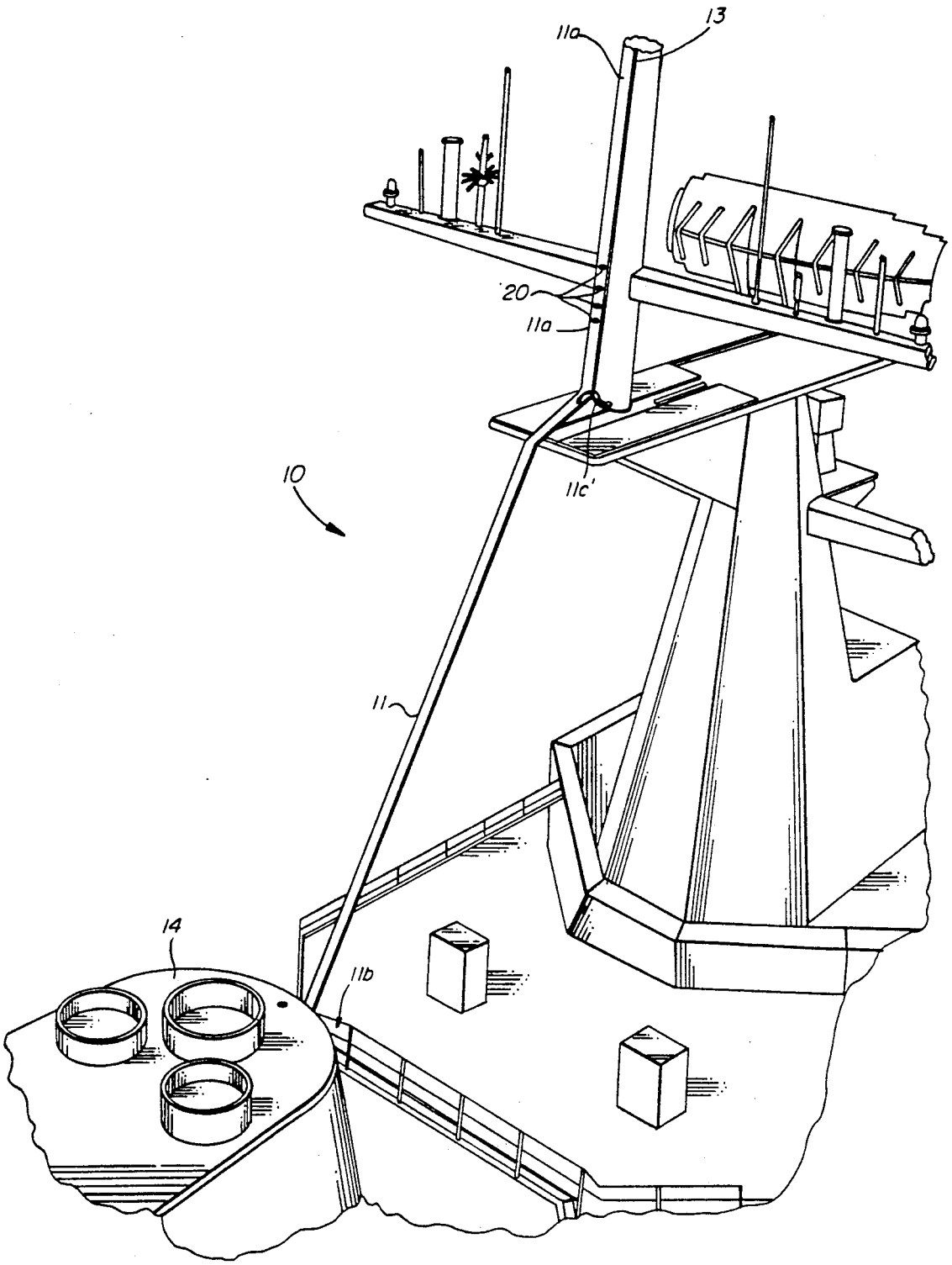
FIG. 3 is another view of the survivable shipboard broadband HF communications antenna capacitively coupled at opposite ends between the mast and stack of a ship's tall structure.

Antenna 10 is a transmission coupler that is connected to driving transmitters and monitoring receivers by an appropriate antenna feed cable or coupling cable 11*c* or 11*c*'. The coupling cable may be connected to element 11 via 11*c* or 11*c*' at the "knee-shaped" transition between 11*a* and 11 or 11*b* and 11, respectively. In addition, the point of interconnection could be moved to some other point including along an end section 11*a* or 11*b* to fine tune the impedance characteristics. The antenna configuration set out in FIGS. 2 and 3 functions as an exciter for the entire ship and has allowed the design of an antenna having a matched impedance exhibiting a voltage standing-wave ratio (VSWR) within 4:1 over the 2–6 MHz frequency band. Radiation patterns obtained for this transmission coupler antenna compare favorably with those measured originally for a conventional twin fan antenna; however, this uncomplicated design not only produces a desired radiation pattern but has an inherent survivability as compared to the twin fan design.

Figure 4:
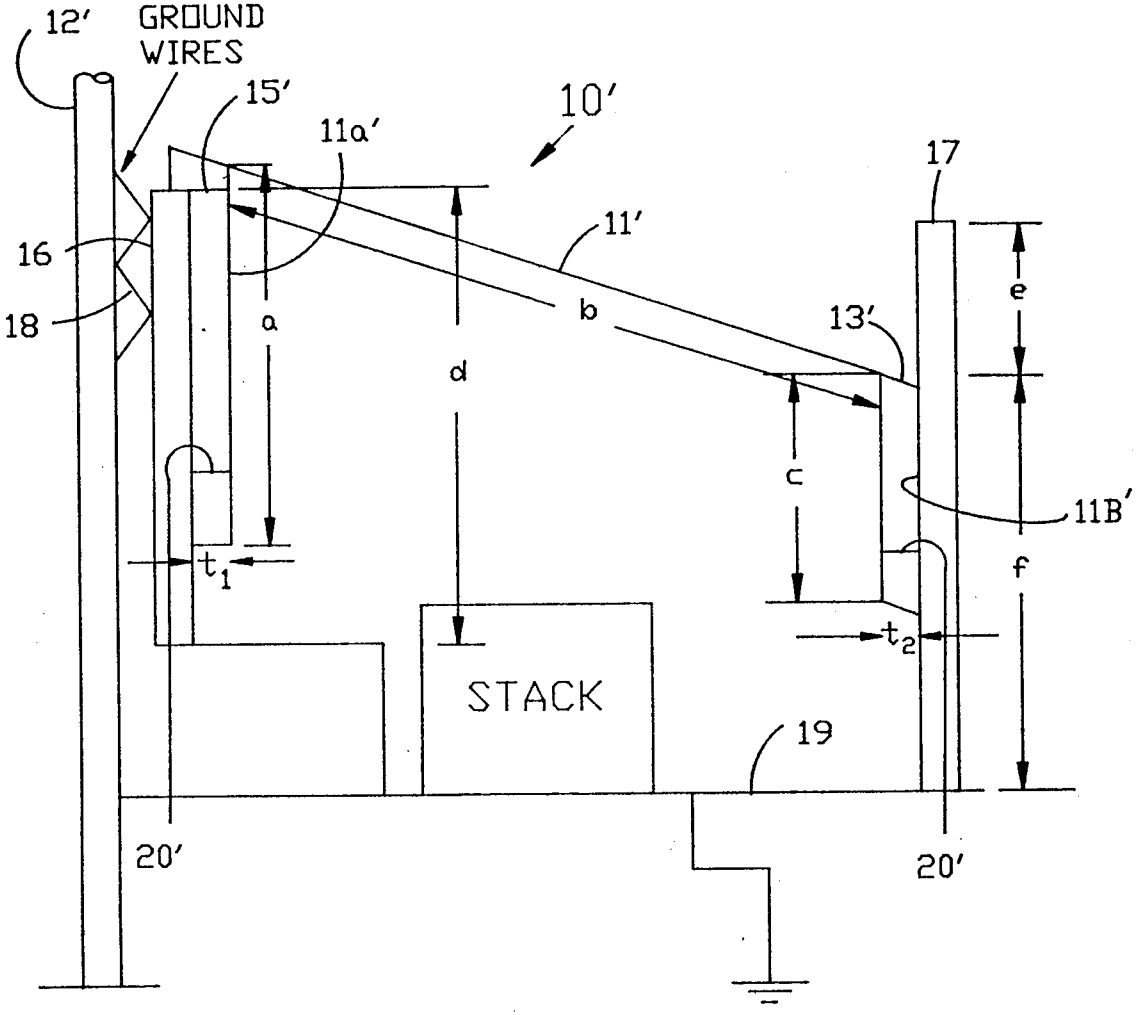
FIG. 4 is a schematic depiction of parameters affecting the design of this survivable antenna.

A modified configuration is schematically shown as antenna 10' in FIG. 4. Antenna 10' has a long, flat conductive strap 11' that is interconnected between fore and aft stanchions 16 and 17 with suitable mounting means 20'. This configuration may be desirable when there is an insufficient distance between a mast and the front of a stack, such as that shown in FIGS. 2 and 3, to permit the use of a long enough exciting element (long, flat conductive strap 11) to achieve the desired operational properties. In addition, the shapes of some superstructures may not lend themselves to the capacitive coupling to end sections 11*a* and 11*b* as described with respect to the embodiment of FIGS. 2 and 3. That is, many protrusions might be found on the mast and stack that prevent the mounting of the end sections.

Since modified configuration antenna 10' was to accommodate surface ships having numerous protrusions on their superstructure, one or more auxiliary masts (stanchions 16 or 17) were erected adjacent existing superstructure elements such as stacks, masts or the like. These auxiliary structures, in addition to being mechanically secured to the existing ship's superstructure, such as masts or stacks, were coupled, electrically to the existing ship's superstructure via a number of ground wires 18.

The ground wires could be dispensed with for some applications. The mechanical coupling between the stanchions and the deck at least partially could also function as an electrical ground interconnection to the rest of the ship in some instances, noting that stanchion 17 is grounded to the deck. Here, it should be noted that what is shown as an aft stancion 17 could be any accessible superstructure to which an antenna could be coupled.

The configuration of FIG. 4 depicts one end of antenna 10' coupled to an existing stanchion 17, while the fore stanchion 16 is coupled via the number of ground wires 18 to mast 12'. In the modified configuration of FIG. 4, as with the embodiment of FIGS. 2 and 3, however, end sections 11a' and 11b' respectively are capacitatively coupled to stanchions 16 and 17 via a layer of dielectric 15' and 13'. The dielectric layer in this embodiment as well as the other configuration can be contiguous layers of polystyrene foam of about 30 centimeters in thickness to achieve the desired capacitive coupling.

Antenna impedance was found to vary when different lengths of aft stanchion extensions were used. A one-forty-eighth scale model configuration utilized a 15¼ inch long, flat conductive strap 11'. This length corresponds to a full scale 61-foot antenna length and yielded the best impedance with the aft stanchion length being 10 and ¾ inches (to correspond to a full scale dimension of 43 feet in length). This permitted end section 11b' to be 3 and ¾ inches long with a width of ¼ inches (to correspond to full scale dimensions of 15 feet in length and 1 foot width, respectively). On the other end of long, flat conductive strap 11', section 11a' had a length of 6 inches with a width of ¼ inch (to correspond to a full scale dimension of 24 feet in length and 1 foot width, respectively) so that a VSWR within 2.8:1 over the 2–6 MHz band was achieved with a calculated three-element matching network (inductor/capacitor-/inductor, T-type).

Feedpoint impedance and calculated matched impedances compared favorably to those of a conventional twin fan antenna.

The length of long, flat conductive strap 11 was shortened in stages to vary only the dimension b, note FIG. 4. The length of end sections 11a' and 11b' (a and c) remain the same as did the height of the fore stanchion 16 (d) and the height of the aft stanchion (f+e). The thickness of the dielectric layers 15' and 13' ($t_1$ and $t_2$) also remain the same. The use of ground wire such as wire 18 was discovered to improve the impedance characteristic somewhat in all cases. When b was reduced to a 52-foot length, the matched impedance VSWR remained within 3:1 over the desired 2–6 MHz HF frequency spectrum. When the dimension b was shortened to 44 feet, the VSWR of the matched antenna increased further. The matched impedance exhibits a VSWR within 3.6:1 over 2–6 MHz. This is acceptable when certain multicouplers requiring only a 4:1 VSWR are used.

The present configuration allows further shortening of the long, flat conductive strap when a wideband communication system is employed. A wideband communication system is more likely to have a VSWR requirement of about 5:1.

Since a polystyrene foam dielectric with a relative dielectric constant of about 1 was used on the model, end sections 11a' and 11b' may necessarily have significantly smaller dimensions than those which were modeled in order to properly control the antenna feedpoint impedance. Additionally, the disclosure has called for a dielectric layer. This is to be construed to also include a series of appropriate dielectric spacers to achieve the dielectric coupling.

Obviously, many modifications and variations of the present invention are possible in the light of the above teachings. It is therefore to be understood that within the scope of the appended claims the invention may be practiced scope of the appended claims the invention may be practiced otherwise than specifically described.

I claim:

1. A survivable broadband transmit HF communications antenna for a ship comprising:

an elongate flat conductive strip provided with an integral end section at opposite ends, each said end section capacitively coupled to said ship, and an integral intermediate section coupled to an antenna feed cable that extends to internal antenna driving circuitry, said elongate flat conductive strip having a sufficient length to extend between portions of the superstructure of said ship to function as an exciter for the entire said ship with an acceptable VSWR;

a dielectric layer contiguously mounted on each said integral end section of said elongate flat conductive strip; and means for providing a portion of said superstructure of said ship disposed adjacent each contiguously mounted dielectric layer on each said integral end section to excite the entire ship to function as said broadband transmit HF communications antenna.

2. An antenna according to claim 1 further including:

means for mounting each said contiguously mounted dielectric layer and each said integral end section to said ship's superstructure providing means to capacitively couple said elongate flat conductive strip to said ship's superstructure providing means to include said ship's superstructure providing means as a part of the HF communications antenna.

3. An antenna according to claim 2 in which said ship's superstructure providing means includes a ship's mast and a ship's stack.

4. An antenna according to claim 3 in which said ship's superstructure providing means includes at least one stanchion.

5. A survivable shipboard broadband HF communications antenna comprising:

an elongate flat conductive strip provided with an antenna feed cable, said elongate flat conductive strip having an integral end section at opposite ends;

a dielectric layer contiguously mounted on each integral end section of said elongate flat conductive strip;

means for providing a portion of a ship's superstructure disposed adjacent each contiguously mounted dielectric layer on each said integral end section to excite the entire ship to function as said HF communications antenna, the ship's superstructure providing means includes a ship's mast, at least one stanchion and a ship's deck; and means for mounting each said contiguously mounted dielectric layer and each said integral end section to said ship's superstructure providing means to capacitively couple said elongate flat conductive strip to said ship's superstructure providing means to include said ship's superstructure providing means as a part of the HF communications antenna, said stanchion includes at least one ground wire coupling it to other of said ship's superstructure providing means.

6. A method of providing a survivable shipboard broadband transmit HF communications antenna for a ship comprising:

positioning an elongate flat conductive strap between portions of the superstructure of said ship, said elongate flat conductive strap having a sufficient length to extend between portions of said superstructure of said ship to function as an exciter for the entire said ship with an acceptable VSWR and having an antenna cable coupled to an integral intermediate section thereof;

fashioning integral end sections at opposite ends of said integral intermediate section of said elongate flat conductive strap to conform to said portions of said superstructure of said ship;

interposing a contiguous dielectric layer between each conforming integral end section of said elongate flat conductive strap and said portions of said superstructure of said ship; and securing said integral end sections and each said dielectric layer to said portions of said superstructure of said ship to capacitively couple said integral end sections to said ship to excite the entire said ship to function as said broadband transmit HF communications antenna.

7. A method of providing a survivable shipboard broadband HF communications antenna comprising positioning an elongate flat conductive strap having an antenna cable between portions of a ship's superstructure;

fashioning integral end sections at opposite ends of said elongate flat conductive strap to conform with said portions of said ship's superstructure;

interposing a contiguous dielectric layer between each conforming integral end section of said elongate flat conductive strap and said portions of said ship's superstructure; and securing said integral end sections and each said dielectric layer to said portions of said ship's superstructure to excite the entire ship to function as said HF communications antenna, the step of securing includes the mounting of at least one stanchion and the electrical coupling of each said stanchion to the other said ship's superstructure with at least one ground wire.

* * * * *